US005375715A

United States Patent [19]

Serre et al.

[11] Patent Number: 5,375,715

[45] Date of Patent: Dec. 27, 1994

[54] POLYGONAL SECTION PACKAGING OF SHEET MATERIAL, IN PARTICULAR FOR BOTTLES AND A BLANK

[75] Inventors: Jean-Claude Serre, Beaune; Bernard Clauzel, Rouillac, both of France

[73] Assignee: Otor, Paris, France

[21] Appl. No.: 155,219

[22] Filed: Nov. 22, 1993

[30] Foreign Application Priority Data

Dec. 28, 1992 [FR] France ..... 92 15777

[51] Int. Cl.[5] ..... B65D 65/12

[52] U.S. Cl. ..... 206/427; 229/934

[58] Field of Search ..... 206/427, 429, 434, 162, 206/431; 229/934

[56] References Cited

U.S. PATENT DOCUMENTS 1,983,010 12/1934 Spees ..... 229/52
2,054,633 9/1936 Kondolf ..... 206/431
3,403,839 10/1968 Farquhar ..... 229/40
3,627,193 12/1971 Helms ..... 229/37
4,932,930 6/1990 Coalier et al. ..... 493/128
5,147,271 9/1992 Bacques et al. ..... 493/143

FOREIGN PATENT DOCUMENTS 2690415 10/1993 France .

*Primary Examiner*—William I. Price
*Attorney, Agent, or Firm*—Fisher, Christen & Sabol

[57] ABSTRACT

Packaging of card or corrugated cardboard in the form of a basket and for the purpose of packaging loads such as rows of bottles. According to the invention the cover of said package is formed by two upsidedown trapezium-section gutters that are engaged one in the other, enabling said cover to be formed accurately regardless of the kind and/or shape of the load. A machine is also provided for enabling such packages to be closed on a continuous basis as they pass through the machine towards an outlet therefrom.

15 Claims, 9 Drawing Sheets

POLYGONAL SECTION PACKAGING OF SHEET MATERIAL, IN PARTICULAR FOR BOTTLES AND A BLANK

The present invention relates to packaging made of card, corrugated cardboard, or similar sheet material, the packaging being polygonal in section, and in particular being generally rectangular in section with corners that are cut off or rounded. The invention also relates to a blank and to a machine for making such packaging.

BACKGROUND OF THE INVENTION

In French patent application No. 92 05069 of Apr. 24, 1992, the Applicant describes such packaging that is generally basket-shaped and at least approximately in the form of a rectangular parallelepiped comprising two identical large lateral faces and two identical small sides faces, said faces being square or rectangular and being connected to one another by means of first parallel fold lines;

- a bottom constituted by first flaps connected to at least some of said lateral faces via second fold lines orthogonal to said first fold lines;
- extensions that extend, from their sides opposite to said bottom, said large lateral faces relative to said small lateral faces; and
- a cover formed by two second flaps respectively connected to said extensions via third fold lines orthogonal to said first fold lines.

To make such packaging, a blank of sheet material such as card or corrugated cardboard is provided, said blank comprising:

- an alternating sequence of at least two large and two small panels that are rectangular or square, the panels being identical in pairs to form said two large and said two small lateral faces, said panels being connected to one another by first parallel fold lines;
- first lateral flaps for forming the bottom of said packaging and disposed on one side of said sequence of panels, being connected to at least some of said panels by second fold lines perpendicular to said first fold lines;
- extensions extending, from their sides opposite to said first lateral flaps, said large panels relative to said small panels; and
- two second flaps for forming the cover of said packaging and respectively connected to said extensions via third fold lines orthogonal to said first fold lines.

Such a blank is used in any suitable manner, by folding and gluing or stapling, and preferably by implementing the techniques described in American patents U.S. Pat. No. 4,932,930 and U.S. Pat. No. 5,147,271, to form an empty package that is open and in which the strip of sides and the bottom are respectively formed by said sequence of panels and by said first lateral flaps, said extensions and said second flaps delimiting a top opening through which the load that is to be contained in said package is inserted. Thereafter, the two second flaps are folded down one on the other and they are fixed together, e.g. by spots or lines of glue disposed between them, while being pressed against the top face of said load, which serves as a backing abutment.

Said second panels thus form the cover of said package, the cover being at least approximately in contact with the top face of said load.

From the above it can immediately be seen that since the top face of the load serves as a backing abutment while the cover is being formed, the quality of the cover formed in this way depends very much on the planeness, the continuity, and the area of said top face. It will easily be understood that if said top face is small, discontinuous, and/or rounded, then the juxtaposing and the fixing of said second flaps can only be approximate.

Furthermore, when the shape of said load is such that its top portion is narrower than its bottom portion, it becomes necessary, whenever said load needs to be held securely by said package, and prior to forming the cover, to apply lateral pressure to said extensions so as to move them towards each other in order to enable them to form a better fit on the upwardly converging lateral walls of said load, with the package then fitting said load as closely as possible for this purpose. Nevertheless, in the event that said load is not completely stable vertically, applying such lateral pressure runs the risk of causing said load or a portion thereof (if it comprises a plurality of items) to tilt sideways to some extent. This therefore constitutes another cause of the cover being formed defectively.

OBJECTS AND SUMMARY OF THE INVENTION

An object of the present invention is to remedy the above drawbacks and to improve the above-described packaging in such a manner that its cover is easy to form and of excellent quality, regardless of the nature, the shape, the area, and any discontinuity in the top face of the load that is to be contained in said package, the package holding said load firmly because it fits the shape thereof more closely.

To this end, the present invention provides a package of sheet material such as card or corrugated cardboard for receiving a load having lateral walls that converge upwardly, said load being held firmly in said package by the fact that said package fits the shape thereof, at least in part, and said package being generally basket-shaped with a lower portion that is at least approximately a rectangular parallelepiped, the package comprising:

- two identical large lateral faces and two identical small lateral faces, said faces being square or rectangular and being connected to one another by parallel first fold lines; and
- a bottom constituted by first flaps connected to at least some of said lateral faces via second fold lines orthogonal to said first fold lines;

said package further including:

- first and second extensions projecting from said lower portion of said package and respectively extending, from their sides opposite to said bottom, said large lateral faces relative to said small lateral faces; and
- a cover comprising first and second superposed second flaps respectively connected to said first and second extensions by third fold lines orthogonal to said first fold lines;

the package being remarkable:

- in that it includes two third flaps respectively connected to said second flaps on their sides opposite to said first and second extensions via fourth fold lines parallel to said third fold lines;
- in that the first of said third flaps connected to said first extension via the first of said second flaps, is pressed against the inside face of said second extension;

in that the second of said third flaps, connected to said second extension via the second of said second flaps is pressed against the outside face of said first extension; and in that at least some fixing means are provided for fixing said second of said third flaps to said first extension.

Thus, in the open position, the package of the present invention has its first and second extensions projecting from said at least approximately rectangular lower portion, themselves extended at their free ends by said first and second second flaps and by said first and second third flaps, respectively, the assembly of said first extension, of said first of the second flaps, and of said first of the third flaps being kept apart from the assembly of said second extension, of said second of the second flaps, and of second of the third flaps to form the opening for loading said package. The said load can then be inserted through said opening, until it has penetrated into said lower portion of the package.

During the closing of said package, the top portion of said first extension, the first of said second flaps, and the first of said third flaps can be shaped to form a first upsidedown gutter of trapezium-shaped section enclosing the sides of the top end of the load, while the top portion of said second extension, the second of said second flaps, and the second of said third flaps may be shaped to form a second gutter that is likewise upsidedown and of trapezium-shaped cross-section, and that encloses the sides of said first gutter. Thereafter, it suffices to exert pressure on the second flap of said second gutter urging it towards the load in the package so as to cause the two gutters to be centered one on the other by a wedging effect, such that the two second flaps are accurately superposed, thus forming an accurate cover. In addition, this cover is centered relative to the top portion of the load since no lateral pressure is necessary to bring one of the second flaps into superposition on the other. Said fixing means, e.g. spots or lines of adhesive placed on the outside face of said first extension ensure that the two gutters are fixed together and thus that the package remains closed. Naturally, additional fixing means may be provided between said second flaps and/or between said second extension and said first of said third flaps.

The package of the present invention is particularly suitable for receiving a load constituted by a plurality of similar bottles. Under such circumstances, the lower portion of the package is designed to fit both in length and in width around said plurality of bottles disposed in a row where they are at least approximately in contact with one another, and the area of said superposed second flaps is such as to enable the flaps to bear against all of the top ends of said bottles.

Parallel to said bottom, said lower portion of the package is rectangular in section. Nevertheless, particularly when the load is constituted by bottles, it is advantageous, for bottle-retaining purposes, for the corners of said lower portion to be cut off or rounded.

Adjacent to said third flaps, said extensions preferably include openings to enable the package to be held in the hand. It will be observed that said third flaps increase the tearing strength of said extensions since they are applied against and/or fixed thereto, and that they thereby act as hand-grip reinforcements.

To this end, it is advantageous for the free edges of said third flaps to include notches that fit the top portions of the outlines of said hand-grip openings. Furthermore, each of said hand-grip openings may include a tongue hinged about the edge of the corresponding hand-grip opening and suitable for engaging a portion of the load contained in the package. Said tongues thus serve to lock said load inside said package.

The present invention also provides a blank of sheet material such as card or corrugated cardboard for making the package described above. Such a blank comprises:

an alternating sequence of at least two large and two small panels that are rectangular or square, and that are identical in pairs for forming said two large and said two small lateral faces, said panels being connected to one another by parallel first fold lines;

first lateral flaps disposed on one side of said sequence of panels and connected to at least some of said panels via second fold lines that are perpendicular to said first fold lines and that are designed to form the bottom of said package;

extensions extending, from the side opposite to said first lateral flaps, said large panels relative to said small panels; and two second flaps designed to form the cover of said package and respectively connected to said extensions by third fold lines orthogonal to said first fold lines.

According to the invention, the blank is remarkable in that it includes two third flaps respectively connected to said second flaps on their sides opposite from said first and second extensions, via fourth fold lines parallel to said third fold lines.

When the load of the package made from said blank is constituted by a plurality of similar bottles disposed in a row and at least approximately in contact with one another, it is advantageous that:

parallel to said second fold lines, said large panels are of a length corresponding to the length of said row of bottles;

parallel to said second fold lines, said small panels are of a dimension corresponding to the diameter of said bottles;

parallel to said first fold lines, the distance between said second and third fold lines corresponds to the height of said bottles;

parallel to said third fold lines, the length of said second flaps corresponds to the overall distance over the top ends of the first and last bottles in said row; and perpendicular to said third fold lines, the width of said second flaps corresponds to the diameter of the top ends of said bottles.

When the lower portion of the package includes corners that are cut off or rounded, said sequence of panels includes additional narrow panels that do not have flaps at their ends and said first flaps have the shape of such a cutoff or rounded corner in the vicinity of the second fold lines connecting them to the corresponding panels.

In order to form the above-mentioned hand-grip means, it is advantageous for said extensions of the blank to include openings adjacent to said second flaps. In which case, the free edges of said third flaps include notches of outlines corresponding to the outlines of said openings. Each opening may include a tongue hinged about its edge.

The packaging of the invention may be shaped, filled, and closed in any conventional manner. Nevertheless, in another aspect of the present invention, a machine is provided for closing said package, which, prior to being closed, is in an open position in which firstly its first and second extensions project from said lower portion that is at least approximately in the form of a rectangular parallelepiped, and are themselves extended at their free ends by said first and second second flaps and by said first and second third flaps, respectively, the assembly comprising said first extension, said first of said second flaps, and said first of said third flaps being kept apart from the assembly comprising said second extension, said second of said second flaps, and said second of said third flaps, and secondly said load being in place in said open package.

According to the invention, the machine is remarkable in that it includes:

displacement means for continuously displacing said package parallel to its large lateral faces from an initial position in which said package is loaded and in said open position as defined above to a final position in which it is closed, enclosing said load;

presser means for continuously pressing said large faces sideways against said load during said displacement; and a combination of means acting successively or partially simultaneously during said continuous displacement of said package and comprising:

first means for forming a first upsidedown gutter of trapezium-shaped cross-section over the top end of said load by shaping the top portion of said first extension, the first of said second flaps, and the first of said third flaps;

second means for pressing and holding said first upsidedown gutter against said top end of said load;

third means for forming a second upsidedown gutter of trapezium-shaped cross-section around said first upsidedown gutter that is pressed and held against said top end of said load, said second gutter being formed by shaping the top portion of said second extension, of the second of said second flaps, and the second of said third flaps;

fourth means for applying spots or lines of adhesive at least between said first extension and the second of said third flaps;

fifth means for applying and holding said second upsidedown gutter engaged over said first upsidedown gutter; and sixth means for pressing said second of said third flaps against said first extension.

Thus, by means of the machine of the invention, said loaded packages can be closed without stopping said packages as they move towards an outlet.

As described in greater detail below:

said means for displacing the package may be formed by a conveyor;

said first means for forming said first gutter may comprise first stationary ramps acting on said top portion of said first extension, on the first of said second flaps, and on the first of said third flaps;

said second means for pressing and holding said first upsidedown gutter against said top end of said load may comprise a presser wheel and first fixed ramps of said first means;

said third means for forming said second gutter may comprise second stationary ramps acting on said top portion of said second extension, on the second of said second flaps, and on the second of said third flaps;

said fifth means for applying and holding said second gutter engaged on said first gutter may comprise an endless presser band and at least one third stationary ramp; and said sixth means may comprise opposing endless bands.

According to yet another aspect of the present invention, an installation is provided for packaging loads, e.g. sets of touching bottles disposed in respective rows, in packages of the invention and made from blanks that are also of the invention.

Such an installation may comprise:

conveyor means;

at least one machine for taking said blanks and making open packages therefrom, and feeding them to said conveyor means;

at least one machine fed with loads and receiving said open packages conveyed by said conveyor means and inserting said loads into said open packages; and at least one machine as specified above.

In this installation, the transporter, the machine for making the open packages, and the machine for loading said open packages may all be of conventional type.

Nevertheless, in an advantageous embodiment of the installation, said machine for making the open packages is of the type described in American patents U.S. Pat. No. 4,932,930 and U.S. Pat. No. 5,147,271.

BRIEF DESCRIPTION OF THE DRAWINGS

The figures of the accompanying drawings show clearly how the invention can be implemented. In the figures, identical references designate elements that are similar. Furthermore, for purposes of simplification and of clarity, identical references are used for the panels and the flaps of the blanks and for the faces or face portions of the corresponding packages, and the same applies to the dimensions (length, width, height) of said panels and flaps and faces, thereby ignoring the thickness of the sheet material from which the packages and the blanks are made.

MORE DETAILED DESCRIPTION

Figure 2:
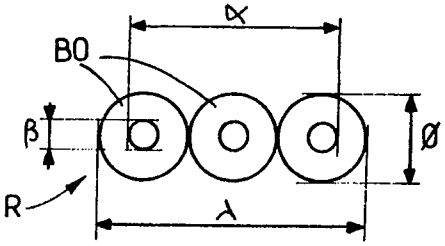
FIG. 2 is a plan view of the FIG. 1 set of bottles.
Figure 1:
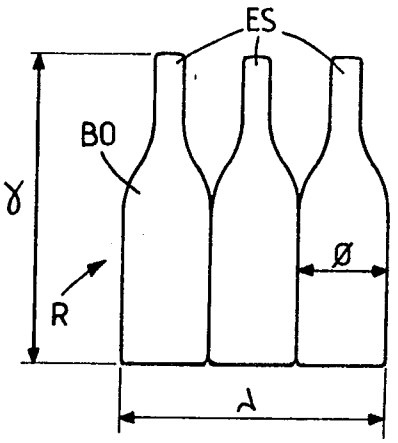
FIG. 1 is an elevation view of a set of bottles touching one another in a row, said set constituting an example of a load for packaging of the present invention.

The set R of bottles BO shown in FIGS. 1 and 2 comprises a plurality of similar bottles (three in the example shown) disposed in a row, said bottles touching one another. Each bottle BO has a diameter $\emptyset$ and a height $\gamma$. The top portion ES of each bottle has a diameter $\beta$.

The set R is of length $\lambda$ and the overall distance between the top ends of the first and last bottles is designated $\alpha$.

Embodiments of card or corrugated cardboard packages of the present invention and described below are given respective references E1, E2, and E3. All of them are generally basket-shaped and are designed to receive a load constituted by said set R of bottles, while fitting closely, at least in part, over the shapes of said bottles BO, in order to hold them firmly in place. It may be observed that since the diameter $\beta$ of the top portions ES of the bottles BO is, in the usual way, smaller than the outside diameter $\emptyset$ of said bottles, said packages need to have lateral walls (hereinafter designated by 1A and 3A) that slope, to converge upwardly towards each other.

These packages E1, E2, and E3 have respective lower portions PI closed by bottoms 10.1, 10.3 and surmounted by pairs of converging lateral walls 1A and 3A, said packages including covers 12.1, 12.3.

The lower portion PI of each package E1, E2, and E3 is substantially in the form of a rectangular parallelepiped. The rectangular section thereof is of length L and of width 1.

Figure 3:
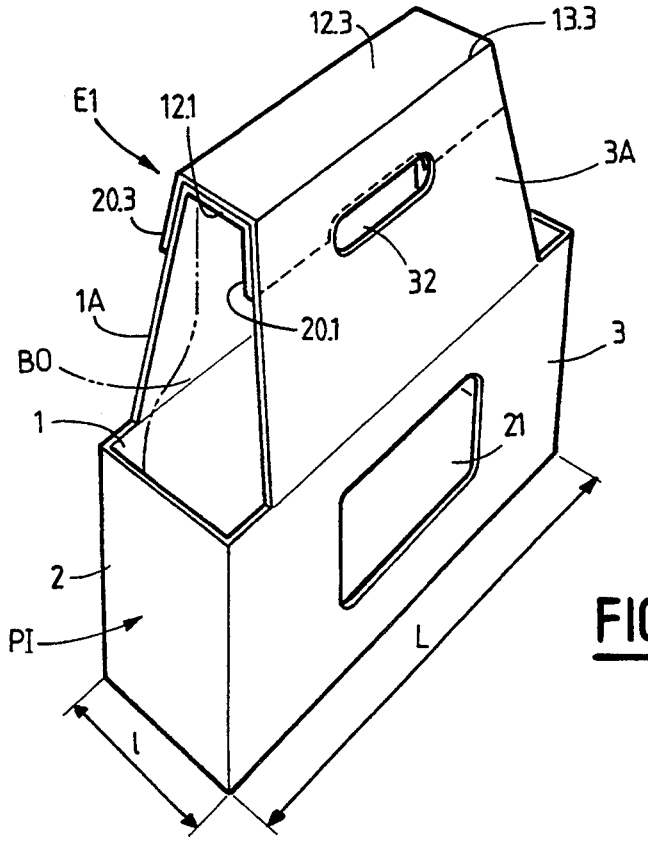
FIG. 3 is a perspective view from above of a first embodiment of a package of the present invention and suitable for receiving the load of FIGS. 1 and 2.
Figure 4:
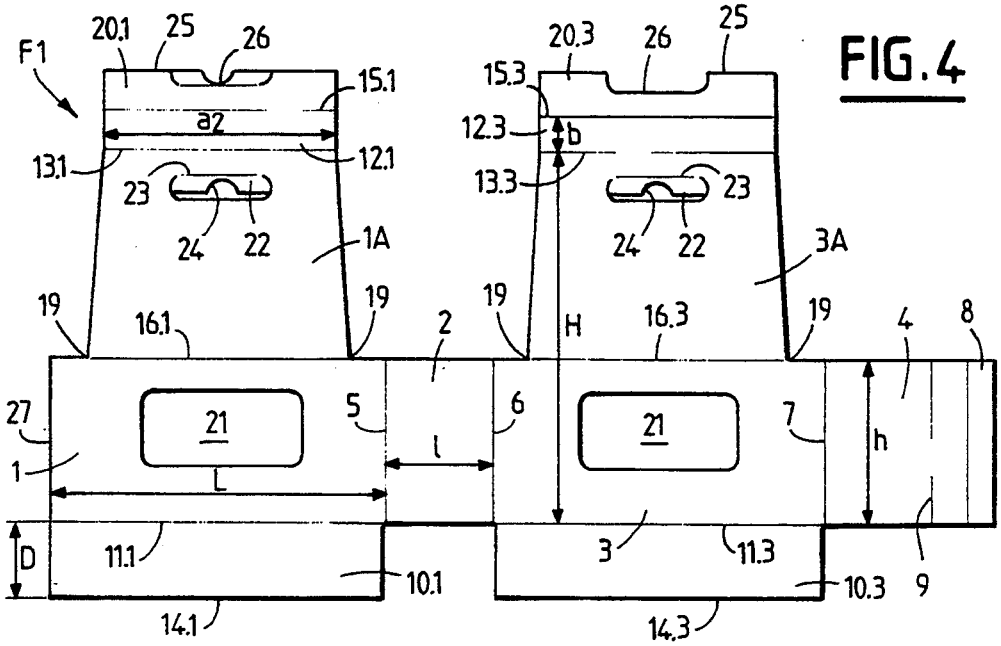
FIG. 4 shows a laid-out flat card blank suitable for making the package of FIG. 3.

The package E1 of the invention and shown in FIG. 3 is made from a blank F1 as shown in FIG. 4.

The blank F1 is made of sheet material, e.g. card or corrugated cardboard and, as shown in FIG. 4, it comprises a sequence of four panels 1, 2, 3, and 4 in alignment, the panels being connected together in pairs by first preformed and parallel fold lines 5, 6, and 7. The first parallel fold lines 5, 6, and 7 are disposed respectively between the panels 1 and 2, 2 and 3, and 3 and 4. Along the free edge of the end panel 4 of said set of panels 1 to 4, there is a tongue 8 which is connected to said end panel 4 by a fold line 9 parallel to the fold lines 5, 6, and 7.

In addition, first flaps 10.1 and 10.3 are provided on one side of each of the panels 1 and 3. Each lateral flap 10.1 and 10.3 is hinged to the corresponding panel 1 or 3 via a second preformed fold line 11.1 or 11.3. The second fold lines 11.1 and 11.3 are in alignment and they are perpendicular to the first fold lines 5, 6, and 7. The height H of the panels 1 and 3 in a direction perpendicular to the fold lines 11.1 and 11.3 is greater than the height h of the panels 2 and 4, such that said panels 1 and 3 are provided, in comparison with the panels 2 and 4, with extensions 1A and 3A along their sides opposite from the flaps 10.1 and 10.3. The panels 1 and 3 are identical, as are the panels 2 and 4. Furthermore, the flaps 10.1 and 10.3 are identical and their length parallel to the corresponding preformed fold line 11.1 or 11.3 is equal to the corresponding length L of the panel 1 or 3 to which the said flap is connected. The ends of the first and second extensions 1A and 3A of the panels 1 and 3 furthest from the first flaps 10.1 and 10.3 have respective second flaps 12.1 and 12.3 hinged thereto about respective third fold lines 13.1 and 13.3. The third fold lines 13.1 and 13.3 are in alignment and they are perpendicular to the first fold lines 5 to 7. Parallel to the second fold lines 11.1 and 11.3, the dimension 1 of the panels 2 and 4 is smaller than the dimension L of the panels 1 and 3.

Thus, the blank F1 comprises two large panels 1 and 3 respectively associated with two first flaps 10.1 and 10.3, and also with two second flaps 12.1 and 12.3. In contrast, the two small panels 2 and 4 are not provided with flaps. The extensions 1A and 3A of the large panels 1 and 3 that project beyond the small panels 2 and 4 are narrower than the base dimension of said large panels, thus being connected thereto via setbacks 19.

The width D of each of said first flaps 10.1 and 10.3 is greater than half the width 1 of the package E1. The free edges 14.1 and 14.3 of the flaps 10.1 and 10.3 are in alignment. Similarly, the remote edges 15.1 and 15.3 of the second flaps 12.1 and 12.3 distant from the panels 1 and 2 are at least approximately in alignment. A respective prefold line 16.1 or 16.3 is provided on each of the large panels 1 and 3 parallel to the fold lines 11.1 and 11.3.

In addition, third end flaps 20.1 and 20.3 are hinged to said second flaps 12.1 and 12.3 along said edges 15.1 and 15.3 which thus form fourth prefold lines parallel to the second and third fold lines 11.1, 11.3, 13.1, and 13.3, and also to the fold lines 16.1 and 16.3.

Cutouts 21 may be provided in the large panels 1 and 3. Furthermore, tongues 22 may be cut out in the first and second extensions 1A and 3A of the panels 1 and 3 being hinged to said extensions 1A and 3A about respective hinge lines 23 and each including a notch 24 in its free edge.

Each of the third end flaps 20.1 and 20.3 includes a notch 26 in its free edge 25 to correspond with the tongues 22.

To make the package E1 of FIG. 3 from a blank F1 of FIG. 4, at least one line of adhesive 28 is applied to the tongue 8 of the blank (or to the panel 1 close to its free edge 27), and said blank F1 is folded about its first fold lines 5, 6, 7, and 9, and said tongue 8 is fixed to the panel 1 in the vicinity of said free edge 27.

This provides a partially formed package E1 (not shown) that has a lower portion PI of rectangular section with the first flaps 10.1 and 10.3 and the extensions 1A and 3A projecting outwardly from the panels 1 and 3. The first flaps 10.1 and 10.3 are then folded towards each other about the second fold lines 11.1 and 11.3, respectively, and they are fixed together, e.g. by gluing, so as to form the bottom of the package. An open package is then obtained as shown on a larger scale and in section in FIG. 5. The zone where the flaps 10.1 and 10.3 are glued together is referenced 29 in this figure.

Figure 5:
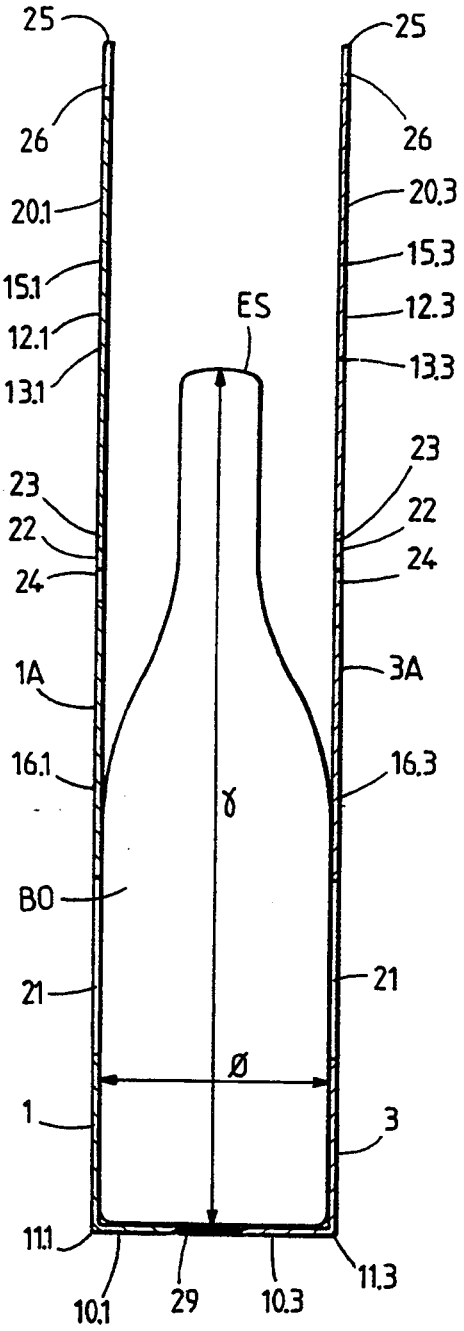
FIG. 5 is a vertical section on a larger scale through the package of FIG. 3, prior to being closed on the load of FIGS. 1 and 2.

The open package of FIG. 5 can then be filled with the load R that it is to contain, namely with the set of bottles BO in alignment along a row R. The bottles BO are inserted between the extensions 1A and 3A that are then in a spaced-apart position, with the width and the length of the package then corresponding respectively to the diameter $\emptyset$ of said bottles and to the length $\lambda$ of the load R, so that such insertion constitutes a relatively snug fit. In this way, said bottles are supported laterally by the panels 1 to 4.

Figures 6A, 6B, 6C, 6D, 6E, 6F, 6G, 6H:
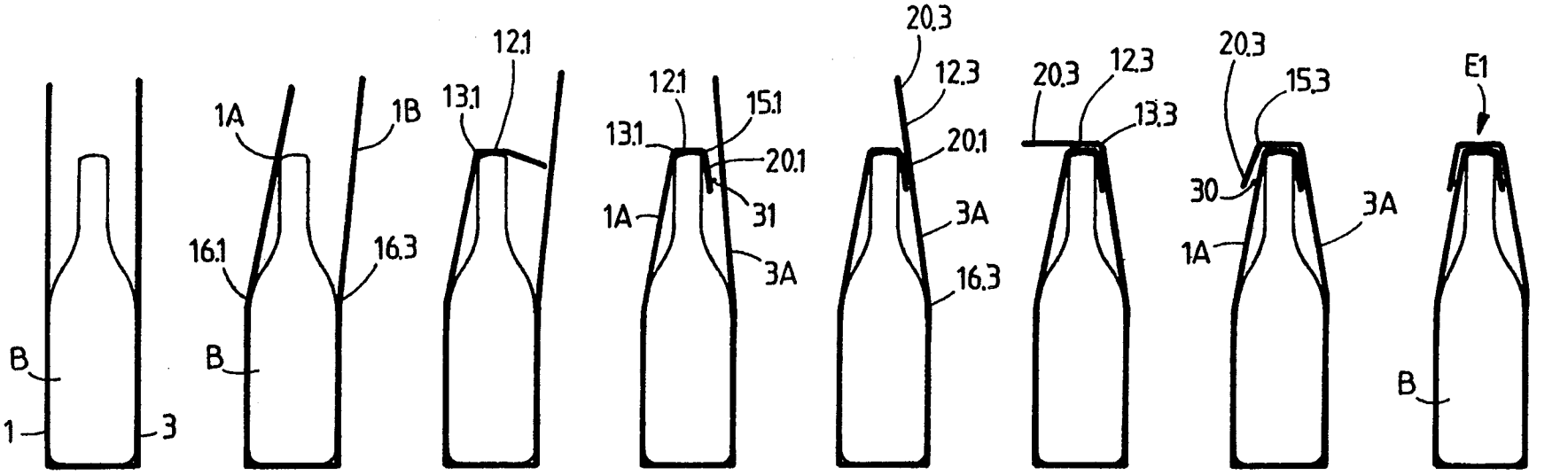
FIGS. 6A to 6H are diagrams showing the process of closing the package of FIGS. 3 and 5.

The package is closed around the bottles BO in the manner shown by diagrammatic FIGS. 6A to 6H, where FIG. 6A corresponds to FIG. 5:

the first step is to fold the first extension 1A secured to the panel 1 a little about fold line 16.1 so as to bring said extension 1A laterally against the bottles BO (FIG. 6B); during this operation, the second extension 1B may be moved a little away from said bottles by being folded outwardly a small amount about line 16.3;

the second flap 12.1 is then folded about the third fold line 13.1 so as to be ready for pressing against the top end ES of the bottles BO (FIG. 6C);

thereafter (FIG. 6D), the third flap 20.1 is folded about the fourth fold line 15.1 so as to be ready for pressing laterally against the bottles BO against the side opposite to said first extension 1A, the necks of said bottles thus being enclosed between the extension 1A and the flaps 20.1 and 20.3;

then (FIG. 6E), the second extension 3A is folded a little about fold line 16.3 so as to bear against the flap 20.1;

after which (FIG. 6F), the flap 12.3 is folded about fold line 13.3 (now superposed over fold line 15.1) and is pressed against the flap 12.1; and the flap 20.3 is folded about fold line 15.3 (now superposed over fold line 13.1) so as to be pressed against extension 1A (FIG. 6G).

The first and second extensions 1A and 3A and the flaps 12.1, 15.1, 12.3, and 15.3 are secured to one another by applying spots or lines of glue 30 between the inside face of the flap.20.3 and the outside face of the first extension 1A (FIG. 6G). Other spots or lines of glue 31 may optionally also be provided between the outside face of the flap 20.1 and the inside face of the second extension 3A.

Figure 7:
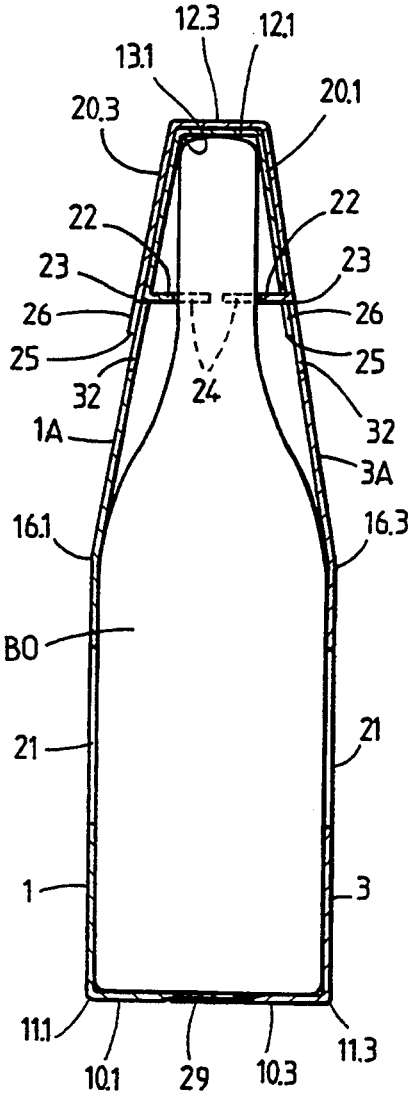
FIG. 7 is a vertical section on a larger scale through the package of FIG. 3, after being closed on the load of FIGS. 1 and 2.

A package 1E is thus obtained that is filled, as shown in FIGS. 6H and 7, in which the first extension 1A and the second and third flaps 12.1 and 20.1 enclose and fit closely over the top ends ES of the bottles BO, while the second extension 3A and the second and third flaps 12.3 and 20.3 enclose and fit closely over said first extension 1A and said flaps 12.1 and 20.1. It will be observed that because the extension 1A and the flaps 12.1 and 20.1 are enclosed by the extension 3A and the flaps 12.3 and 20.3, the fold lines 13.1 and 13.3 and the fold lines 15.1 and 15.3 are not in exact alignment in order to make allowance for the thickness of the sheet material constituting said blank F1.

As described above, the lower portion PI of the package E1 fits both in length and in width around the row R of bottles BO. In addition, the superposed second flaps 12.1 and 12.3 are of an area such as to enable them to press against all of the top ends ES of all of the bottles BO in the load R.

More explicitly, in order to ensure that the bottles BO are held firmly in the package E1, provision is made as follows:

parallel to said second fold lines 11.1, 11.3, said large panels 1 and 3 are of a length L that corresponds to the length $\lambda$ of said row R of bottles BO;

parallel to said second fold lines 11.1 and 11.3, said small panels 2 and 4 are of dimension 1 corresponding to the diameter $\emptyset$ of said bottles;

parallel to said first fold lines 5, 6, 7, and 9, the distance H between said second and third fold lines corresponds to the height $\gamma$ of said bottles;

parallel to said third fold lines 13.1 and 13.3, the length a of said second flaps 12.1 and 12.3 corresponds to the overall distance $\alpha$ covering the top ends of the first and last bottles in said row; and perpendicularly to said third fold lines, the width b of said second flaps corresponds to the diameter $\beta$ of the top ends of said bottles.

In the situation shown in FIGS. 6H and 7, it can be seen that the tongues 22 are folded into the package E1, i.e. they are folded towards each other about the fold lines 23, thereby leaving openings 32 suitable for acting as hand-grip means for said package E1, and also serving to hold the facing bottles BO in place, since said notches 24 then fit around the neck of the bottle (see FIG. 7).

It will be observed that each of said third flaps 20.1 and 20.3 (whose notches 26 then overlie the top edges of the corresponding openings 32) when in place over the extension 1A or 3A above the corresponding opening 32 serves to reinforce the tearing strength of the package E1 when the package is held by means of the openings 32.

Figure 8:
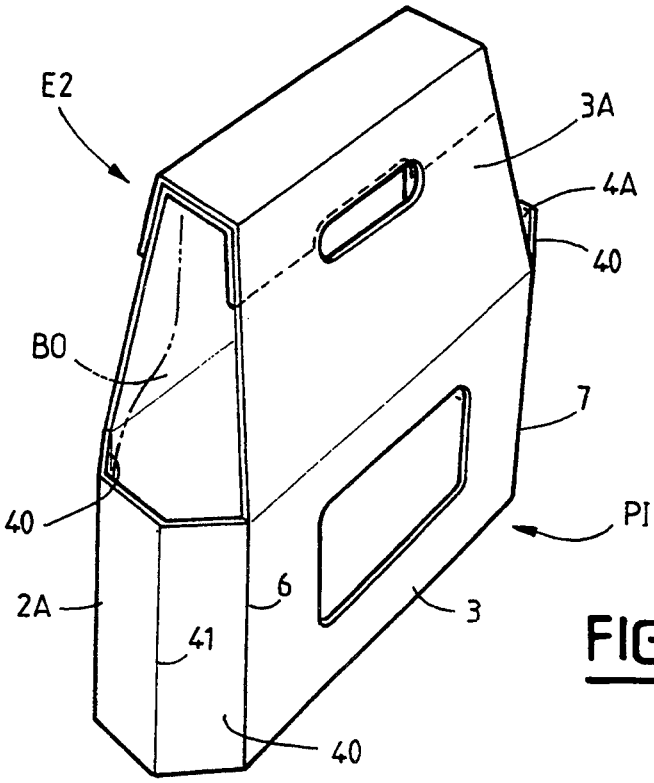
FIGS. 8 and 10 are perspective views from above of two other embodiments of packaging of the invention.
Figure 9:
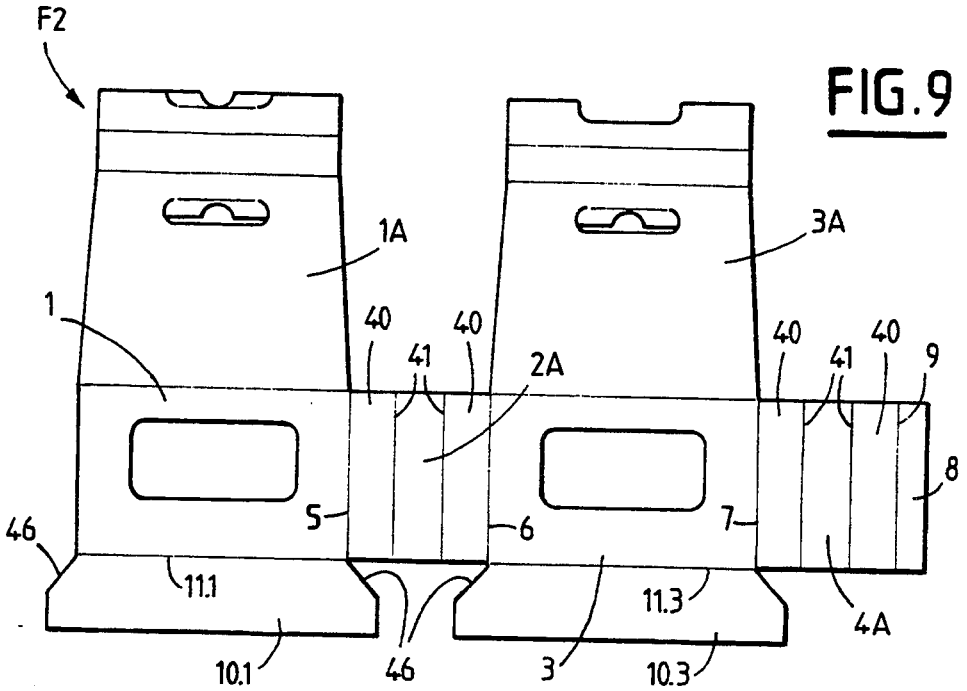
FIGS. 9 and 11 show laid-out flat blanks of card for making the packages of FIGS. 8 and 10, respectively.

The variant embodiment E2 of the package of the present invention as shown in FIG. 8 is essentially similar to the package E1 of FIG. 3. The only difference lies in the corners of the rectangular block-shaped portion PI being cut off in order to provide a better fit to the shape of the end bottles BO, thus giving rise to oblique faces 40. In this case, the small faces 2 and 4 are reduced in width to become respective end facets 2A and 4A each connected to two oblique faces 40 via fold lines 41 (parallel to the fold lines 5, 6, 7, and 9), said oblique faces 40 being connected in turn to the panels 1 and 3 via the first fold lines 5, 6, 7, and 9. FIG. 9 shows the blank F2 appropriate for making the package E2, which FIG. 9 should be compared to FIG. 4 that shows the blank F1 for the package E1.

In FIG. 9, it can be seen that the first flaps 10.1 and 10.3 are longer in the direction parallel to the second fold lines 11.1 and 11.3 than the corresponding panels 1 and 3, so that in the vicinity of said second fold lines, said flaps have oblique edges 46 that correspond to said oblique faces 40. Thus, when said first flaps 10.1 and 10.3 are folded towards each other to form the bottom of the package E2, they match the octagonal section of the lower portion PI of the package (i.e. a rectangular section with cutoff corners).

Figure 10:
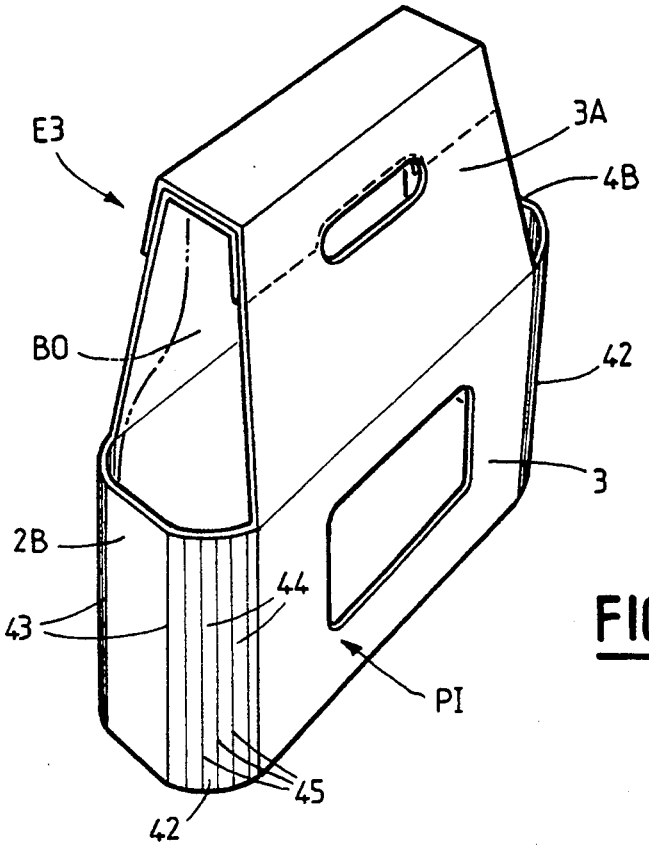
Figure 11:
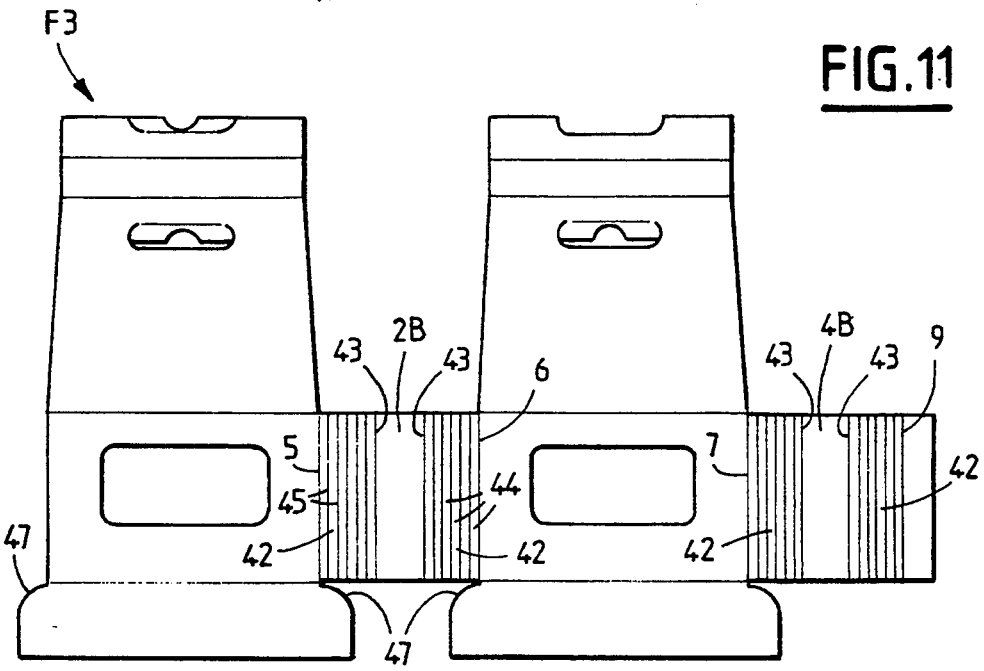

The second variant embodiment E3 of the package of the present invention as shown in FIG. 10 is likewise generally similar to the package E1 of FIG. 3. In this case, the difference lies in that for reasons identical to those mentioned above for the package E2, the corners of the rectangular block-shaped lower portion PI have been rounded so as to give rise to portions 42 that are at least substantially cylindrical. Here again, the small faces 2 and 4 are reduced in width to become respective end facets 2B and 4B, connected on either side to the cylindrical portions 42 by fold lines 43, said cylindrical portions 42 being connected to the faces 1 and 3 via the first fold lines 5, 6, 7, and 9. Each cylindrical portion 42 is made up of a plurality of facets 42 that are connected to one another by fold lines 45. The fold lines 43 and 45 are parallel to the fold lines 5, 6, 7, and 9. FIG. 11 shows the blank F3 for making the package E3, said FIG. 11 being comparable to FIGS. 4 and 9 which show respective blanks F1 and F2. In this case, instead of having oblique edges 46, rounded edges 47 are provided that adapt to the cylindrical portions 42.

Figure 12:
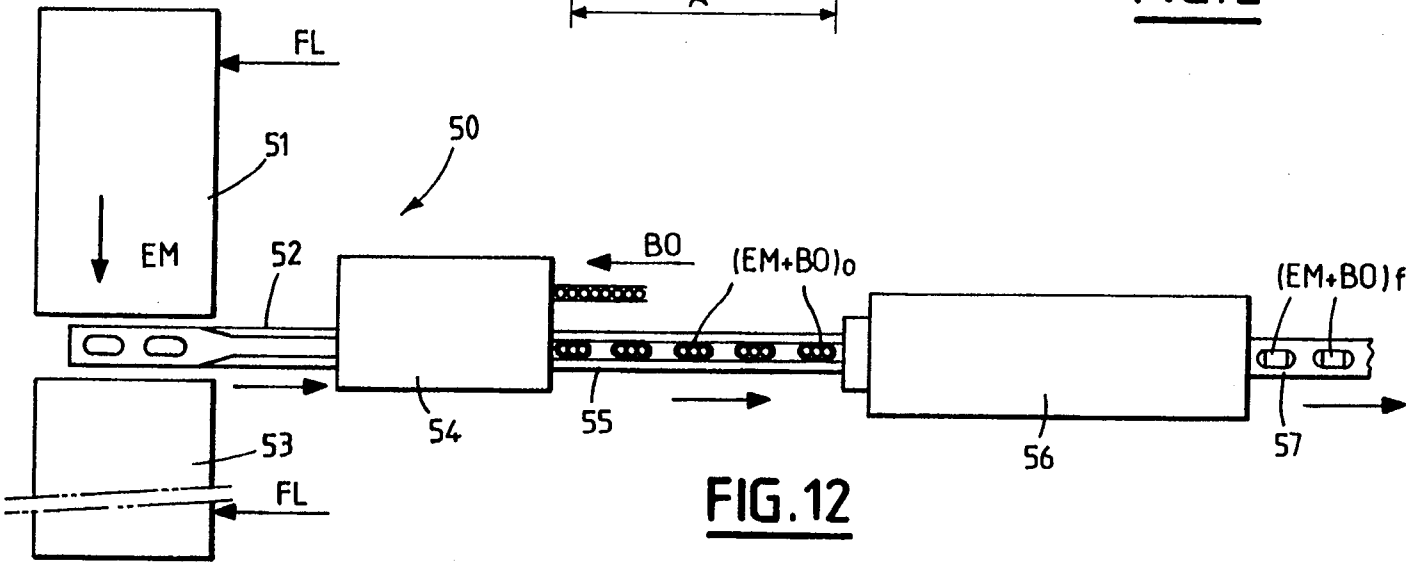
FIG. 12 is a diagrammatic plan view of an installation for making packages of the present invention, for loading them, and for closing them around their loads.

FIG. 12 is a diagrammatic plan view of an installation 50 of the present invention for packaging loads R in packages of the invention.

The installation 50 comprises a machine 51, e.g. of the type described in American patents U.S. Pat. No. 4,932,930 and U.S. Pat. No. 5,147,271, which is fed with blanks FL (FL corresponding to F1, F2, or F3) and which delivers open packages EM (EM corresponding to E1, E2, or E3) to a conveyor 52. These packages have their lower portions PI standing on the conveyor 52 and they extend longitudinally in the advance direction of said conveyor 52, while their extensions 1A and 3A, and also their second and third flaps that are secured thereto are positioned apart from one another.

Optionally, another machine 53 similar to the machine 51 is also provided for feeding the conveyor 52 with packages EM.

The conveyor 52 delivers the packages EM that are open and empty to a loading machine 54 which is also fed with bottles BO. The loading machine 54 inserts the said bottles BO in known manner into the packages EM such that on leaving the machine 54, each package EM contains its load R of bottles BO. The packages EM are then in the open position and they are loaded, as shown diagrammatically in FIGS. 5 and 6A. In FIG. 12, packages that are loaded but still open are given the reference $(EM+BO)_o$.

A conveyor 55 delivers the packages EM containing their loads R as provided by the machine 54 to a closing machine 56, and a particular embodiment of the closing machine is described below with reference to FIGS. 13, 14, and 15.

Thus, after passing through the closing machine 56, the packages EM are closed over their loads R, as shown diagrammatically in FIGS. 3, 6H, 7, 8, and 10.

The packages EM once loaded and closed, are referenced $(EM+BO)_f$ in FIG. 12, and they are taken away from the closing machine 56, e.g. by means of a conveyor 57.

Figure 13:
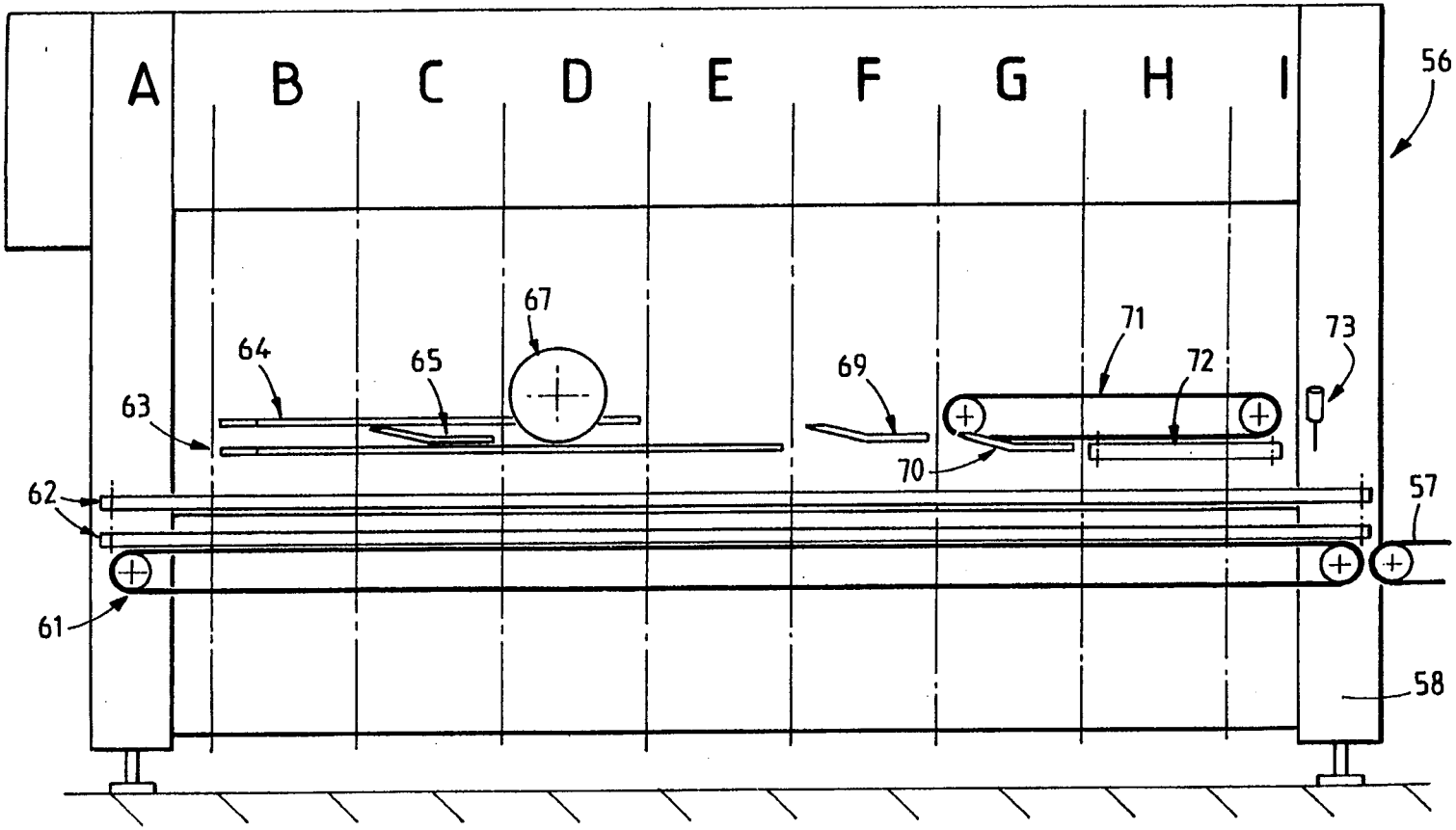
FIGS. 13 and 14 are diagrams respectively in elevation and in plan view of the package-closing machine of the FIG. 12 installation.
Figure 14:
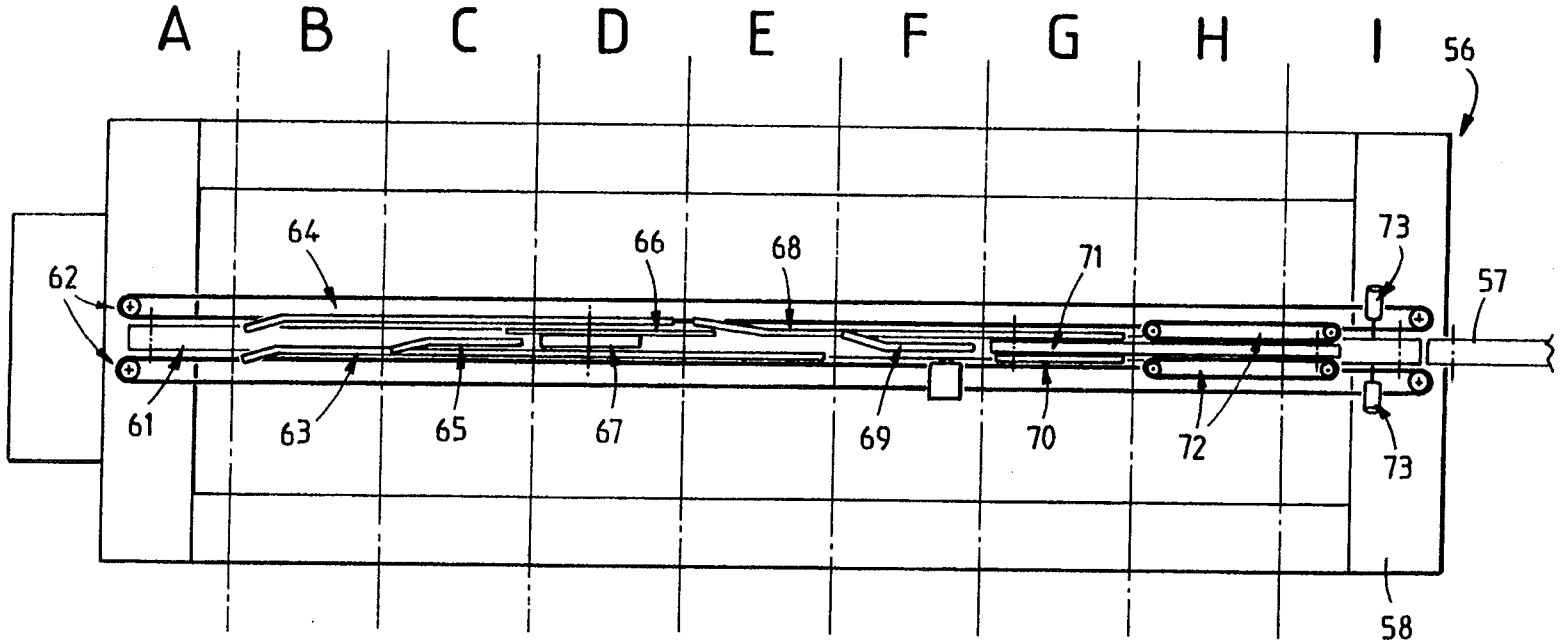
Figures 15A, 15B, 15C, 15D, 15E, 15F, 15G, 15H, 15I:
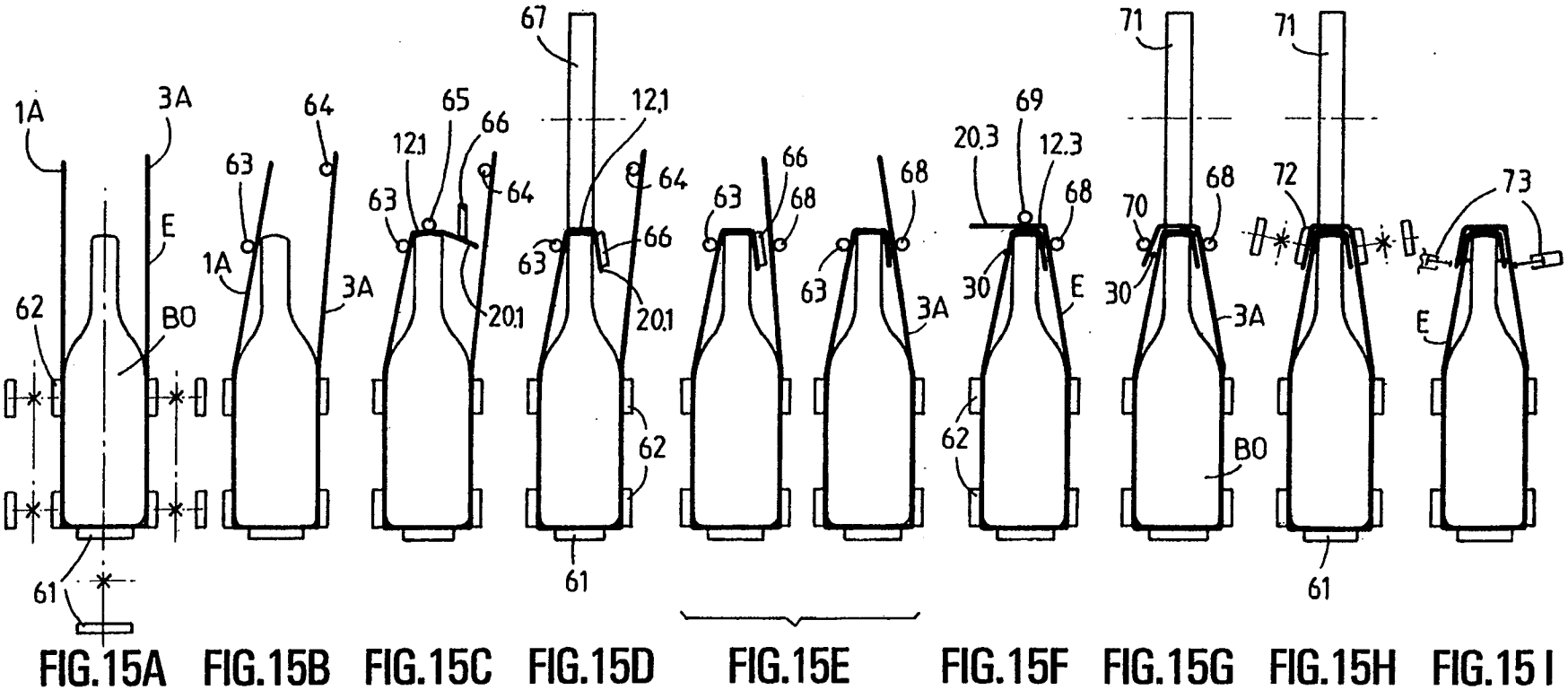
FIGS. 15A to 15I explain the operation of the package-closing machine of FIGS. 13 and 14.

As shown diagrammatically in FIGS. 13 and 14, the closing machine 56 comprises a frame 58 standing on the ground, and, mounted on said frame 58:

- an endless belt conveyor 61 supporting the lower portions PI of the packages EM and conveying said packages from an initial position (shown in FIG. 15A) in which said packages EM are open and loaded, to a final position in which said packages are closed (shown in FIG. 15I). While the packages EM are being conveyed by the conveyor 61 from one position to another, the large faces 1 and 3 of the packages extend parallel to the displacement direction;
- endless side bands 62 designed to press continuously against the large faces 1 and 3 of said packages against their loads R of bottles BO throughout their displacements through the machine;
- a plurality of stationary ramps 63 to 66 and 68 to 70 disposed on the path of said packages EM;
- a presser wheel 67;
- endless presser bands 71 and 72;
- presser actuators 73; and
- a glue-dispensing device 74.

To understand how the closing machine 56 operates, FIGS. 15A to 15I are diagrams showing nine stages A to I during a closing operation, stage E being a double stage, and in FIGS. 13 to 14, the zones of said closing machine 56 are indicated in which said stages A to I are respectively performed.

In successive stages B, C, and D, a first upsidedown gutter of trapezium-shaped section is formed over the top ends ES of the bottles BO constituting the loads R, with this being done by shaping the top portion of the first extension 1A, together with the first of the second flaps 12.1 and the first of the third flaps 20.1, and said first upsidedown gutter is pressed and held against said top ends ES of said loads R.

To do this, as the packages EM travel through the machine, the following stages take place in succession:

1/starting from the initial position of FIG. 15A, the ramp 63 causes the first extension 1A and the flaps 12.1 and 20.1 that are integral therewith to move towards the bottles BO until said first extension 1A is pressed laterally against said bottles. Simultaneously, the ramp 64 obliges the second extensions 3A and the flaps 12.3 and 20.3 that are secured thereto to keep away from the bottles BO (so as to facilitate subsequent folding down of the flaps 12.1 and 20.1). The result of stage B is shown in FIG. 15B;

2/the ramps 63 and 64 continue to press against and keep apart the extensions 1A and 3A respectively, the ramp 65 bringing the flap 12.1 so as to bear against the top ends ES of the bottles BO, and the ramp 66 begins to fold down the flaps 20.1 against the face of the bottles BO that faces the extension 3A (see FIG. 15C); and 3/the ramps 63 and 64 continue to press against and keep apart the extensions 1A and 3A respectively, the ramp 66 bringing the flap 20.1 to press laterally against the bottles BO, and the presser wheel 67 pressing the flap 12.1 against the top ends ES of said bottles (see FIG. 15D).

Thereafter, during successive stages E, F, G, and H, a second upsidedown gutter of trapezium-shaped cross-section is formed around said first upsidedown gutter which is pressed and held against said top end ES of the load R, the second gutter being formed by shaping the top portion of said second extension 3A, the second of said second flaps 12.3 and the second of said third flaps 20.3, and said second gutter is pressed against, held on, and fixed to said first gutter.

To do this, following above stages B, C, and D, the following successive stages are performed:

4/the ramps 63 and 64 continue their action as described for stage D, the ramp 64 is interrupted, and the ramp 68 obliges the second extension 3A and the flaps 12.3 and 20.3 associated therewith to move towards the bottles BO (see lefthand portion of FIG. 15E). Thereafter, the ramp 68 brings said second extension 3A to bear laterally against said bottles, while there is a break in the ramp 66, with the lateral pressure exerted by the ramp 66 being taken up without interval by the ramp 68 (see right-hand portion of FIG. 15E);

5/the ramp 68 continues its action, the ramp 69 brings the flap 12.3 to bear against the top ends ES of the bottles BO, and the glue-dispensing device 74 deposits lines or spots of glue 30 on the outer face of the extension 1A (see FIG. 15F);

6/the ramp 68 continues its action, and the flap 12.3 is pressed against the top ends ES of the bottles BO without discontinuity by the endless band 71 following a break in the ramp 69. In addition, the ramp 70 progressively folds the flap 20.3 onto the extension 3A and the lines or spots of glue 30 (see FIG. 15G); and 7/the action of the ramps 68 and 70 is then taken over by the endless bands 72 which exert opposing lateral pressures enabling the flap 20.3 to be stuck onto the extension 1A, while the endless band 71 continues to apply pressure on the flap 12.3 against the top ends ES of the bottles BO (see FIG. 15H).

Downstream from the endless bands 71 and 72, opposing actuators 73 apply lateral pressure pulses so as to punch out the tongues 22 and make the hand-grip cutouts visible to the user.

Thereafter, the loaded and closed packages EM are taken away by the conveyor 57.

We claim:

1. A package of sheet material for receiving a load having lateral walls that converge upwardly, said load being held firmly in said package by the fact that said package fits the shape thereof, and said package being generally basket-shaped with a lower portion that is at least approximately a rectangular parallelepiped, the package comprising:

two identical large lateral faces and two identical small lateral faces, said faces being rectangular and being connected to one another by parallel first fold lines; and a bottom constituted by first flaps connected to at least some of said lateral faces via second fold lines orthogonal to said first fold lines;

said package further including:

first and second extensions projecting relative to said lower portion of said package and respectively extending, from their sides opposite to said bottom, said large lateral faces relative to said small lateral faces; and a cover comprising first and second superposed second flaps respectively connected to said first and second extensions by third fold lines orthogonal to said first fold lines;

the package including:

two third flaps respectively connected to said second flaps on their sides opposite to said first and second extensions via fourth fold lines parallel to said third fold lines;

wherein the first of said third flaps connected to said first extension via the first of said second flaps, is pressed against the inside face of said second extension;

wherein the second of said third flaps, connected to said second extension via the second of said second flaps is pressed against the outside face of said first extension; and wherein at least some fixing means are provided for fixing said second of said third flaps to said first extension.

2. A package according to claim 1, for receiving a load constituted by a plurality of similar bottles, wherein the lower portion of the package fits both in length and in width around the plurality of bottles disposed in a row and at least approximately in contact with one another, and wherein said superposed second flaps are of an area enabling them to bear against all of the top ends of said bottles.

3. A package according to claim 1, wherein the section of said lower portion parallel to said bottom is rectangular, with cutoff corners.

4. A package according to claim 1, wherein the section of said lower portion parallel to said bottom is rectangular, with rounded corners.

5. A package according to claim 1, wherein said extensions include hand-grip openings beside said third flaps.

6. A package according to claim 5, wherein the free edges of said third flaps include notches that fit around the top portions of the outlines of said hand-grip openings.

7. A package according to claim 5, wherein each of said hand-grip openings includes a tongue hinged about the edge of the corresponding hand-grip opening and suitable for engaging against a portion of the load contained in said package.

8. A blank of sheet material for making the package specified in claim 1, said blank comprising:

an alternating sequence of at least two large and two small panels that are rectangular, and that are identical in pairs for forming said two large and said two small lateral faces, said panels being connected to one another by parallel first fold lines;

first lateral flaps disposed on one side of said sequence of panels and connected to at least some of said panels via second fold lines that are perpendicular to said first fold lines and that are designed to form the bottom of said package;

extensions extending, from the side opposite to said first lateral flaps, said large panels relative to said small panels; and two second flaps designed to form the cover of said package and respectively connected to said extensions by third fold lines orthogonal to said first fold lines, including two third flaps respectively connected to said second flaps on their sides opposite from said first and second extensions, via fourth fold lines parallel to said third fold lines.

9. A blank according to claim 8, for making packaging that is designed to receive a load constituted by a plurality of similar bottles disposed in a row so as to be at least approximately in contact with one another, wherein:

parallel to said second fold lines, said large panels are of a length corresponding to the length of said row of bottles;

parallel to said second fold lines, said small panels are of a dimension corresponding to the diameter of said bottles;

parallel to said first fold lines, the distance between said second and third fold lines corresponds to the height of said bottles;

parallel to said third fold lines, the length of said second flaps corresponds to the overall distance over the top ends of the first and last bottles in said row; and perpendicular to said third fold lines, the width of said second flaps corresponds to the diameter of the top ends of said bottles.

10. A blank according to claim 8, designed to form a package whose lower portion is rectangular in section with cutoff or rounded corner parallel to said bottom, wherein said sequence of panels includes additional narrow panels that do not carry flaps at their ends, and wherein said first flaps present, in the vicinity of the second fold lines connecting them to the corresponding panels, the shape of such a cutoff or rounded corner.

11. A blank according to claim 8, wherein said extensions include openings adjacent to said second flaps.

12. A blank according to claim 11, wherein the free edges of said third flaps include notches of outlines corresponding to the outlines of said openings.

13. A blank according to claim 11, wherein each of said openings includes a tongue hinged about the edge of the corresponding opening.

14. A package according to claim 1, wherein the sheet material is selected from the group consisting of card and corrugated cardboard.

15. A package according to claim 8, wherein the sheet material is selected from the group consisting of card and corrugated cardboard.

* * * * *